US005479750A

United States Patent [19]

Carlberg

[11] Patent Number: 5,479,750

[45] Date of Patent: Jan. 2, 1996

[54] JOIST CAP

[76] Inventor: Stanley B. Carlberg, 6628 Manchester La., Eden Prairie, Minn. 55434

[21] Appl. No.: 29,518

[22] Filed: Mar. 11, 1993

[51] Int. Cl.[6] ..... E04H 12/00

[52] U.S. Cl. ..... 52/300; 52/716.8; 52/717.03; 52/737.5; 428/192

[58] Field of Search ..... 52/716.8, 717.03, 52/717.05, 718.04, 725, 728, 730.1, 300, 480, 481, 92.1; 428/192; 156/202

[56] References Cited

U.S. PATENT DOCUMENTS

| | | | |
|---|---|---|---|
| Re. 18,573 | 8/1932 | Kocher . | |
| 2,232,905 | 2/1941 | Dyer | 52/300 |
| 2,365,854 | 12/1944 | Albaugh | 52/300 X |
| 2,862,255 | 12/1958 | Nelson . | |
| 3,180,460 | 4/1965 | Liskey, Jr. . | |
| 3,349,519 | 10/1967 | Nehlig | 52/717.05 X |
| 3,349,533 | 10/1967 | Gregore | 52/716.8 |
| 3,385,018 | 5/1968 | Harry . | |
| 3,451,169 | 6/1969 | Arnold et al. | 52/716.8 X |
| 3,473,281 | 10/1969 | Omholt . | |
| 3,996,712 | 12/1976 | Howell | 52/300 X |
| 4,127,974 | 12/1978 | Wendt | 52/717.05 X |
| 4,404,783 | 9/1983 | Freiburg | 52/98 X |
| 4,443,508 | 4/1984 | Mehl | 52/716.8 X |
| 4,449,342 | 5/1984 | Abendroth . | |
| 4,601,073 | 7/1986 | Methot | 52/300 X |
| 4,666,028 | 5/1987 | Saito et al. | 52/718.04 X |
| 4,775,570 | 10/1988 | Ohlenforst et al. | 428/192 X |
| 4,783,943 | 11/1988 | Ljungkvist . | |
| 4,838,000 | 6/1989 | Ljungkvist . | |
| 4,854,099 | 8/1989 | Kristoffersen . | |
| 4,860,508 | 8/1989 | Jackson et al. . | |
| 4,879,856 | 11/1989 | Jones et al. . | |
| 4,916,871 | 4/1990 | Anderson | 52/98 |
| 5,213,870 | 5/1993 | Yamamoto | 428/192 X |

*Primary Examiner*—Lanna Mai
*Attorney, Agent, or Firm*—Haugen and Nikolai

[57] ABSTRACT

An elongated water impermeable joist cap adapted to be disposed upon the top of a joist and used in outdoor structures, such as decks and gazebos. The joist cap is adapted to be disposed between the joist or stringers and the supported flooring, such as decking, to inhibit water from becoming entrapped therebetween and rotting the joist, which would otherwise reduce the useful life of the outdoor structure. Fasteners, such as nails or deck screws, can be driven through the supported structure and the joist cap and into the joist during construction. The joist caps are uniquely designed to redirect water which may form on the outer surface of the joist cap outward and away from the joist. The joist caps are scored such that they can be easily broken at pre-determined lengths for easy and quick installation upon a pre-selected length of joist. In the alternative embodiment of the present invention, a joist cap which is adapted to be used between multiple joists fastened to one another in the side to side arrangement and a supported structure is disclosed. The joist caps can be easily manufactured using extrusion processes.

10 Claims, 3 Drawing Sheets

JOIST CAP

BACKGROUND OF THE INVENTION

1. Field of the Invention

This invention relates generally to outdoor construction apparatuses, and more particularly to apparatuses adapted to reduce rotting of joists due to moisture trapped between the supporting end of a joist and a supported material.

2. Background of the Invention

Outdoor structures, such as decks, gazebos etc., are subject to the harsh environment generated by mother nature including heat, humidity, and rain. Decks, for example, are typically constructed of a supporting structure formed of spaced joists or stringers which support decking extending transverse to the end of the joist supporting the decking. The supported decking is typically secured to the joist using standard fasteners, such as nails or screws, to obtain a sound structure.

While the exposed decking material can be protected from the weather by treating, such as by staining and water sealing with commercially available products, the joists are typically comprised of treated lumber to achieve a structure with a satisfactory useful life. However, even joists comprised of treated lumber eventually rot due to the moisture which becomes entrapped between the joist and the supported decking. Even though the ends of the joists are usually not directly exposed to the atmosphere, the porous properties of wood act as a wick and pull moisture from rain or condensation under the decking and facilitates rotting.

Prior art apparatuses are known to prevent moisture and humidity from rising beneath flooring of indoor structures, and which may be disposed between joists and the flooring for cushioning the surfaces against one another, and to achieve a dampening of sound.

U.S. Pat. No. Re. 18,573 teaches a sound deadening device comprising a felt strip located between a furring strip and the top layer of the floor. However, the felt strip is not water impermeable and would not reduce joist rot, nor is taught to be disposed over a joist between the joist and a surface which is subjected to the outdoor environment.

U.S. Pat. No. 3,385,018 to Harry teaches a support member dimensioned to conform to corrugated panels to be used for walls, roofs etc. Disposed between each corrugated panel and each support member is an elastomeric, ribbon-like winged filler strip of flexible, relatively dense material. The filler strip is directed towards cushioning to surfaces against one another, and is not adapted to prevent moisture from becoming entrapped between the support member and the panels.

U.S. Pat. No. 3,180,460 to Liskey, Jr. teaches a cushion strip upon which floor panels rest. The strips cushion the panels and seal the marginal portions of the floor panels against leakage of air or seepage of dust therebetween. This device, however, is not adapted to prevent damage due to moisture generated from above the joists.

U.S. Pat. No. 4,879,856 to Jones et al., teaches a floor system designed to be placed over an undersized joist in order to provide some additional stability for the support member. Since the structure taught in Jones is primarily designed for interior use, it would be only marginally effective for reducing water damage to the top of the joist.

OBJECTS

It is accordingly a principle object of the present invention to provide a joist cap adaptable to the top of a joist and between a supported structure for reducing water damage to the joist.

It is a further object of the present invention to provide a joist cap which redirects moisture away from the joist to increase the usable life of the constructed structure.

It is still yet a further object of the invention to provide a joist cap which can be selectively formed to adapt to one or more adjacently positioned joists.

It is still yet a further object of the present invention to provide a low cost joist cap which is easy to manufacture, which is easy to use, and which can be configured to custom lengths for easy incorporation in structures.

SUMMARY OF THE INVENTION

The foregoing objects and advantages of the present invention are achieved by providing an elongated joist cap adaptable to the end of a joist which is comprised of a water impermeable U-shaped member. The U-shaped member is defined by a pair of wings separated by a segment and which together define a notch therebetween for receiving the end of the joist in a snug fit. Each of the wings terminate at a distal end and are structured to route moisture disposed on the cap outer surface away from the notch and the received joist. Materials, such as decking, can then be supported by the joist and the adapted U-shaped member such that moisture cannot be entrapped between the joist and the supported materials. Thus, rotting of the joists due to entrapped moisture is eliminated. The U-shaped member is preferably comprised of a flexible material formed using extrusion techniques, and may also be comprised of a resilient material to provide a cushioning effect.

In the preferred embodiment, both distal ends extend away from the notch, and taper to a point such that water will drip downward therefrom and away from the joist. The outer surface of the segment is preferably domed to have an arcuate convex surface to facilitate a water-tight seal between the joist and the decking, and to establish a small contact area therebetween to promote venting.

In an alternative embodiment, the distal ends of the wings include elongated tabs extending outwardly from the notch and define a channel extending the length of the cap. Preferably, a web is provided for coupling the segment to each of the wings for enabling the wings to hinge and flex outwardly from the defined notch such that the cap is adaptable to joists of various widths in a snug friction fit. The segment has a channel defined in an outer surface thereof extending the length of the member for providing a means for routing water from beneath the supported member, but can also be domed.

In yet an alternative embodiment of the present invention the joist cap comprises an elongated water impermeable plate-like member having an upper and lower surface, and a pair of edges that can be selectively hinged to form a U-shape joist cap of a selectable width. The member has at least webbed portion defined by a channel defined in the upper surface which extends the length of the member between the edges. Preferably, a plurality of channels are defined in the upper surface at predetermined and uniform intervals, wherein the upper surface is domed therebetween. The member preferably comprises a second channel disposed on the lower surface also extending the length of the member to further define the webbed portion. Ideally, the second channels are defined opposite the first channels and correspond to each other to create webbing facilitating a flexible member. Ideally, the intervals between the channels defined on approximately 1⅝ centers, corresponding to the standard width of standard construction materials. Since a plurality of channels are defined, the cap can be adapted to one or more adjacently positioned joists by bending the cap at the appropriate webbed portions formed by the opposing channels. Again, the joist cap may comprise of a resilient material to provide a cushioning effect, wherein all joist caps preferably are scored at pre-determined intervals, such as at 1" spacings, to facilitate bending and snapping the cap in the lateral direction to achieve a cap of pre-determined length.

Other objects, features and advantages of the present invention will become apparent to those skilled in the art through the Description of the Preferred Embodiment, Claims, and drawings herein.

DESCRIPTION OF THE PREFERRED EMBODIMENT

Figure 1:
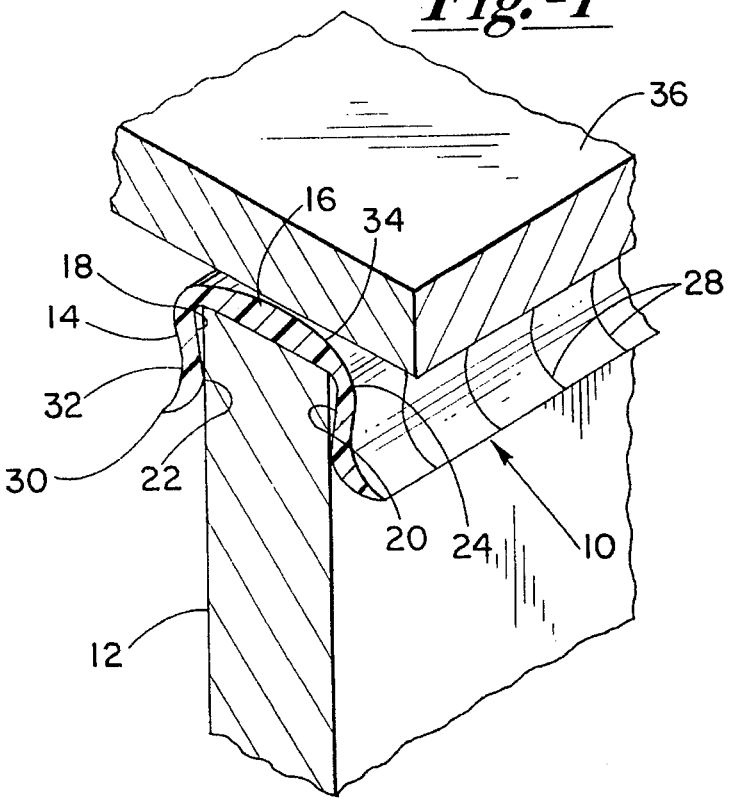
FIG. 1 is a section perspective view of the water impermeable joist cap according tó the preferred embodiment of the invention adapted to the top of a joist and supporting decking.

An elongated water impermeable joist cap 10 according to the preferred embodiment of the present invention is shown in FIG. 1 adapted to the top supporting end of a joist or stringer 12. Joist cap 10 has a U-shaped cross-section, as shown, defined by a pair of wings 14 extending downwardly from a horizontal segment 16. The notch defined by wings 14 and segment 16 has a width dimension adapted to closely conform to the width of a standard joist, such as 1⅝ inches. However, cap 10 can have a width dimension confoxing to two or more joists, such as 3¼" or 4⅞" spacings Thus, limitation to this dimension is not to be inferred as joists having greater or lesser widths can be accommodated as well using appropriately designed joist caps.

The width dimension of the notch defined by wings 14 and segment 16 is slightly greater proximate segment 16 as shown to define a small opening shown at 18. Openings 18 provides tolerance for joists covered with shavings, dirt, or which are slightly larger in width than 1⅝". Each wing 14 has an inner surface 20 which tapers from the inner surface of segment 16 and toward each, thus engaging the received joist 12 at a tangent contact at 22. These tapering inner surfaces of wings 14 provide a clip-like feature of cap 10 for receiving joist 12.

Joist cap 10 is preferably comprised of a water permeable flexible material, such as plastic, and preferably polypropylene formed using extruded processes. Each wing 14 also has a narrowed width dimension shown at 24 to provide webs such that each wing 14 can flex about webs 14 from segment 16. When clip 10 is removed from joist 12, the width dimension of the notch formed by joist cap 10 between points 22 of each wing 14 is of a dimension slightly less than the width of joist 12. Thus, when joist cap 10 is adapted about the top of joist 12, each wing 14 will be flexed slightly outward to receive joist 12 in a snug fit, wherein each wing 14 engages joist 12 in a tight friction contact at respective locations 22.

One key feature of joist cap 10 is that each wing 14 extends downwardly and terminates at a respective tapered tip 30. Each tip 30 is defined outward and away from the notch and joist 12. The outer surface 32 of each wing 14 extends outwardly from joist 12 such that moisture or condensation which may form on the outer surface of joist cap 10 will proceed downwardly to the tips 30 and drip therefrom, away from joist 12. Hence, the top surface or end of each joist 12 remains dry thus extending the useful life of the framework formed by a plurality of joists 12.

Another key feature of joist cap 10 is that the upper outer surface of segment 16, shown at 34, has a curved, arcuate convex or dome shape. Thus, floor boards or decking material, shown at 36, rests upon joist cap 10 at a single point in a tangental relationship along the length of joist cap 10. Thus, a minimal contact area is generated, and moisture will not collect between joist cap 10 and the decking or floor material 36 thus extending the useful life of the support structure and floor material 36.

Since joist cap 10 is comprised of a flexible plastic material of moderate thickness, fasteners, such as nails or screws, can be driven through the floor material 36, through joist cap 10, and into the upper support surface of joist 12 to be secured thereto. While a thin metal material could be used to form joist cap 10, plastic is preferred since it is non-corrosive, provides a water seal around the fasteners, can be formed of color coordinated plastics, is more flexible, and can have resilient properties to provide a sound dampening feature as well. A plastic material having a resilient property will dampen noise and vibration generated when one walks upon support surface 36.

Still yet another feature is the lateral scoring of the cap 10 at predetermined intervals, such as at 1" spacings, as shown at 38. Scoring 38 facilitates snapping the cap at predetermined locations to obtain a cap of desired length, without losing the water impermeable feature, and without requiring cutting or additional tooling.

Figure 2:
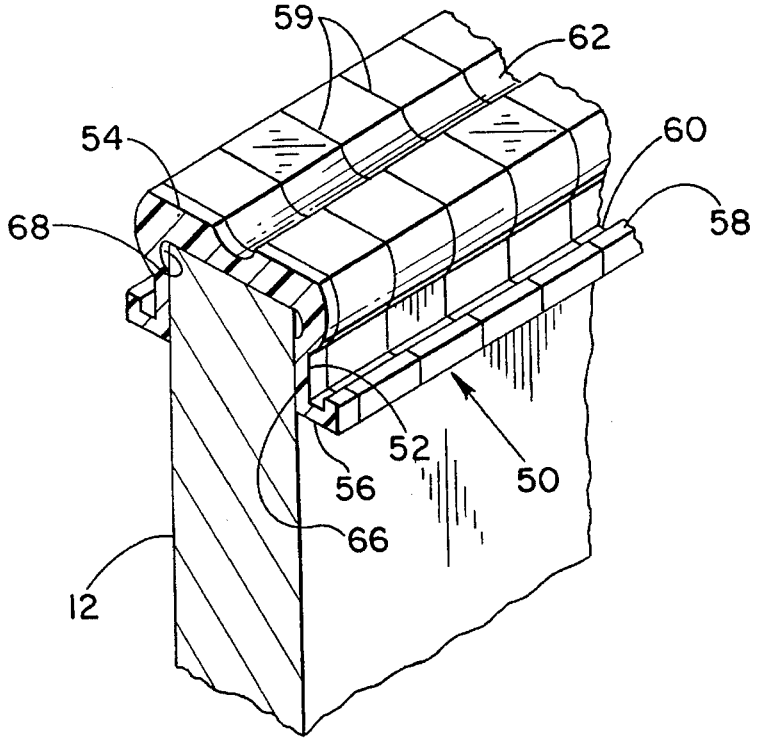
FIG. 2 is a sectional perspective view of an alternative embodiment of the invention comprising an elongated joist cap adapted to a joist and having a pair of wings each defining a channel or trough.

An alternative embodiment of the present invention is shown in FIG. 2 and now will be discussed in considerable detail. An alternative embodiment of a joist cap is shown at 50 and comprises a pair of wings 52 extending downwardly from a laterally extending segment 54 to define a U-shaped notch for receiving one or more joists 12 in a snug fit, similar to joist cap 10 shown in FIG. 1. However, joist cap 50 has distinguishing features from cap 10 in that each wing 52 includes a laterally extending longitudinal tab 56 terminating at a lip 58 to define an elongated channel 60 on each side of joist cap 50. Thus, moisture or condensation formed on the outer surface of joist cap 50 will become disposed in channel 60 and flow forwardly or rearwardly along joist cap 50, and not downwardly, to keep the sides of joist 12 dry. Tab 56 and lip 58 also can serve a second purpose, such as providing an attachment structure for ceiling lowered blinds, sunscreens, bugscreens used on porches, or hanging items such as plants when used to form solariums.

Another novel unique feature of joist cap 50 is a centrally defined water channel 62 having a concave profile. Channel 62 extends the length of joist cap 50 to allow moisture which may form between joist cap 50 and the supported structure 36 to escape. Thus, water or moisture can be directed outward from underneath the support structure 36, rather than remaining entrapped between joist cap 50 and the support structure 36 to prevent or reduce rotting of joist 12. Joist cap 50 also has scoring lines 59 defined at predetermined intervals, similar to scoring 38 shown in FIG. 1.

Joist cap 50 is also comprised of plastic water impermeable material, such as polypropylene, and is flexible. However, resilient materials can be used as well to provide sound dampening and vibration dampening features. Each wing 52 has a narrowed web portion at 53 such that each wing 52 can flex outwardly during adaption to one or more joists 12 as needed. The inner walls 66 of each wing 52 are tapered slightly towards each other when not adapted to joist 12 such that the inner wall 66 will engage joist 12 in a tight friction fit when adapted about joist 12. However, the inner walls 66 can also be defined parallel to one another, and limitation to tapering inner wall 66 is not to be inferred. Spacing 68 is similar to spacing 18 shown in FIG. 1 to allow for tolerances of joist 12.

During installation of floor material 36, fasteners, such as nails or deck screws, can be disposed through the floor material 36, through segment 54 and into the top of joist 12 as previously described. Segment 54 is sufficiently thick such that it will not crack or split when fasteners are disposed therethrough. Polypropylene is an ideal plastic for the present invention material since it is less subject to cracking when nails are driven therethrough, is flexible, performs well in harsh temperatures and weather, and it is slightly resilient to provide sound dampening and vibration dampening features.

It is recognized other unique distal ends for wings 14 or 52 shown in FIGS. 1 and 2 can be provided as well which are designed to redirect water or moisture upon the outer surface thereof from dripping downward and along joist 12. Hence, limitation to the unique distal ends of the respective wings shown in FIGS. 1 and 2 is not to be inferred.

Figure 3:
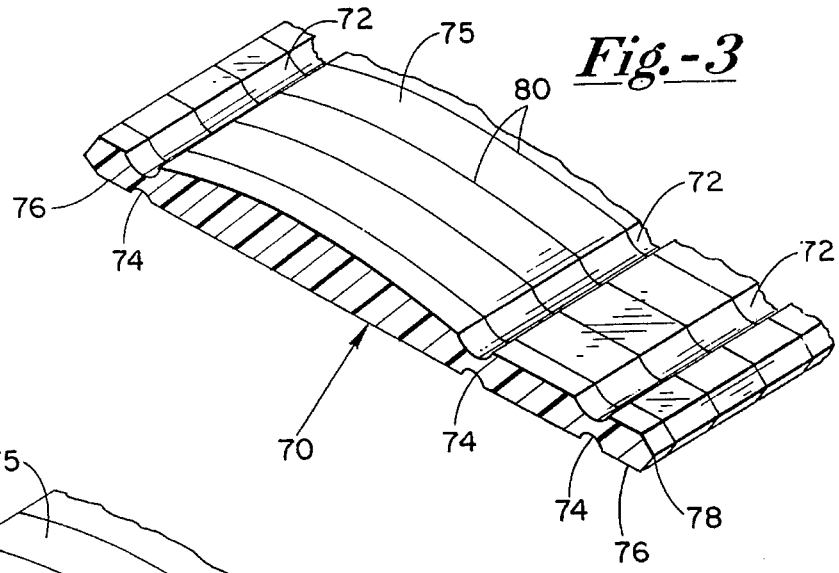
FIG. 3 is a perspective view of still yet another alternative embodiment comprising a water impermeable plate-like joist cap adaptable to a plurality of joists, and having a pair of extending wings and a plurality of elongated channels defining webbed portions.
Figure 4:
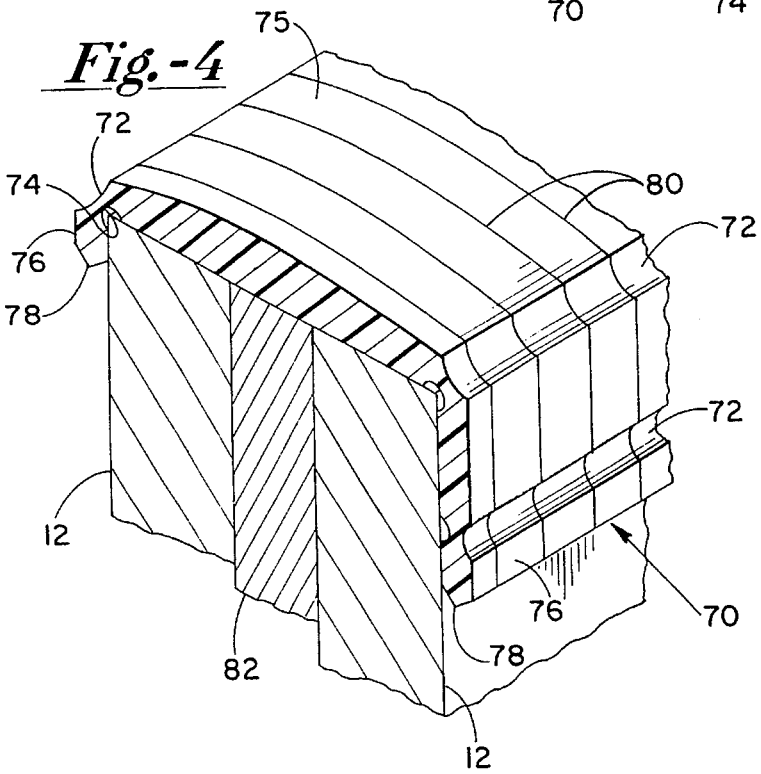
FIG. 4 is a sectional view of the cap of FIG. 3 adapted to a pair of joists separated by a sheet of plywood, wherein the cap is folded at the appropriate webbed portions. The cap can also be adapted to three joists by folding at the outermost webbed portions.

Now turning to FIGS. 3 and 4, an alternative preferred embodiment of the present invention is shown. Referring to FIG. 4, a pair of joists 12 are shown secured to one another and separated by a ½" sheet of plywood 82, wherein a joist cap 70 according to an alternative embodiment of the present invention is shown adapted thereupon. Joist cap 70 comprises a plate-like water impermeable plastic material, such as polypropylene, having a plurality of water channels 72 and 74 defined in an upper and lower surface thereof, each defined opposite one another on the opposite surfaces to also form multiple web portions for hinging. A pair of wings 76 having tapered tips 78 are defined along each edge of cap 70. Each of water channels 72 and 74, and wings 76 extend the entire length of cap 70.

One pair of channels 72 are separated by a domed portion 75 having a span of 3¾". Floor material 36 will make tangent contact with surface 75, similar to domed section 34 of FIG. 1. All other portions of the top surface between channels 72 are planar, but could also be domed if desired. The other water channels 72 and 74 which also provide hinging points, are defined at predetermined intervals, such on 1⅝ inch centers. A water channel can be defined and positioned over each interface between two or more joists 12 secured side to side, and the portions of cap 70 extending therefrom folded downward. Thus, if three joists 12 are positioned in a side to side relationship, a pair of water channels can be positioned over the two interfacing surfaces, and the wings 76 folded downward at the respective hinge points defined by channels 72 and 74. Limitation to a joist cap 70 having only the number of channels shown is not to be inferred. Member 70 is scored at pre-determined intervals to facilitate snapping the joist cap to obtain a pre-determined length, similar to the scoring 38 shown in FIG. 1.

During installation, joist cap 70 is positioned over the pair of joists 12 and the plywood 85 sandwiched therebetween, as shown in FIG. 4, and temporarily secured thereto using small nails driven through cap 70 into the top of joists 12. Next, each wing 76 is folded downward at the hinges formed by channels 72 and 74 above the outer edges of the joists to form a U-shaped member. Each wing 76 is secured in a downward position by driving a stainless steel ring nail through each wing 76 into the side of respective adjacent joist 12. Subsequently, floor boarding or decking 36 is installed upon the top of cap 70. The upper surface 75 of cap 76 will form a tight water seal against the lower side of the decking, providing venting under the decking from outside the lateral edge of the respective joists 12. Joist cap 70 also can have resilient properties to provide sound dampening and vibration dampening features.

Figure 5:
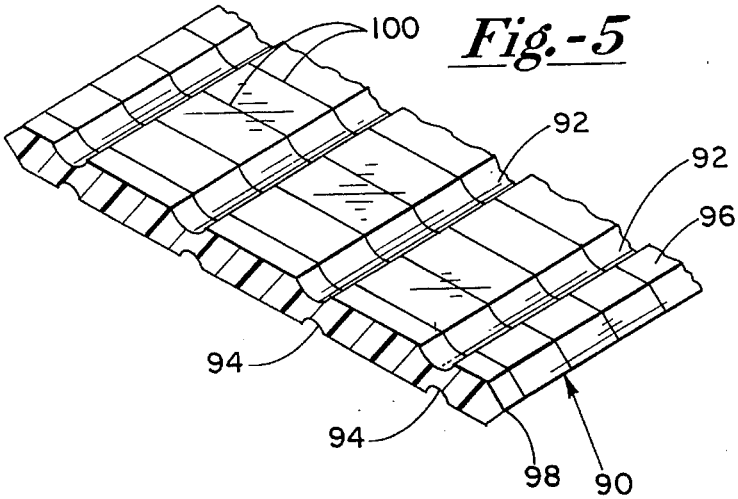
FIG. 5 is a perspective view of an alternative embodiment of a cap adaptable to one, two or three adjacently positioned joists.
Figure 6:
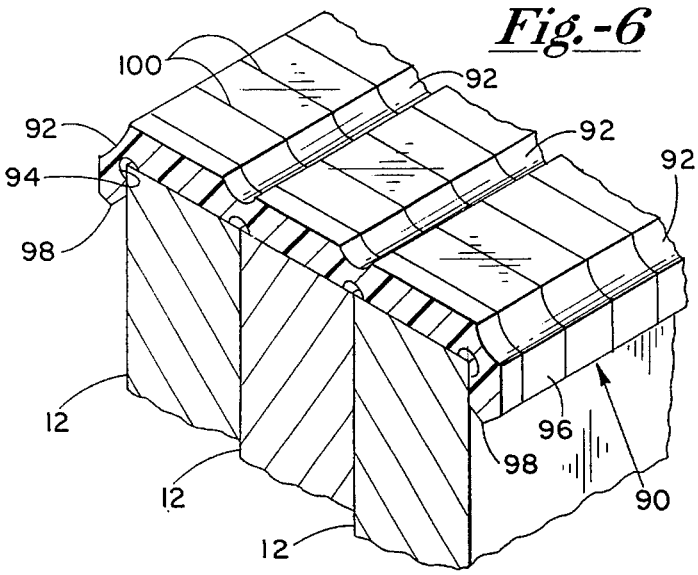
FIG. 6 is a sectional view of the cap shown in FIG. 5 adapted to two adjacent joists.
Figure 7:
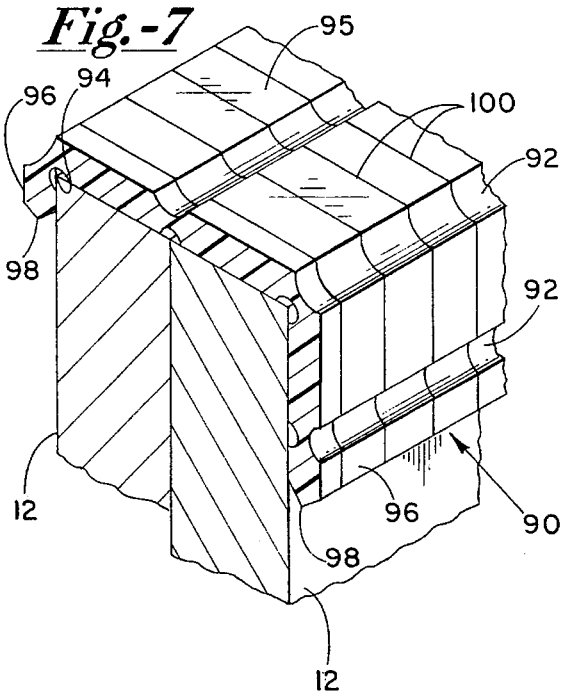
FIG. 7 is a sectional view of the cap shown in FIG. 5 adapted to three adjacent joists.

Referring now to FIG. 5, an alternative embodiment of the invention shown in FIG. 3 is shown. A joist cap 90 similar to joist cap 70 is formed of polypropylene plastic and has a generally planar shape. A plurality of uniformly spaced channels 92 are formed in an upper surface thereof and extend the entire length of cap 90. A plurality of water channels 94 are defined in the lower surface opposite the water channels 92 and also extend the entire length of joist cap 90. Together, each pair of opposing channels 92 and 94 form narrowed web portions to facilitate hinging, as shown in FIGS. 6 and 7. However, it is recognized that a webbed portion can be defined by only a single channel defined in either surface, and limitation to webbed portions formed by two opposing channels is not to be inferred. Each side of joist cap 90 is defined by a wing portion 96 tapering to a tip 98, which tip serves to direct water outward and away from the respective joists when adapted thereto, as shown in FIGS. 6 and 7. Joist cap 90 is scored at pre-determined fixed intervals, such as every 1", as shown at 100, to facilitate snapping the joist cap 90 at preselected locations to obtain a cap of pre-determined length.

Referring to FIG. 6, joist cap 90 is adapted about 3 joists each having widths of 1⅝". Each wing 96 is folded or hinged at webbed portions formed by channels 92 and 94 above the outermost edges of the arrangements of joists. Referring to FIG. 7, joist cap 90 is folded about web portions positioned over the edges of two joists. Cap 90 can even be adapted to a single joist by bending cap 90 at the appropriate webbing. Thus, joist cap 90 is adaptable to one or more adjacently positioned joists to provide a multipurpose and versatile joist cap. Limitation to four channels defined on each surface of joist cap 90 is not to be inferred. However, arrangements of greater than 3 joists are not common in the industry. Similar to joist cap 70 shown in FIG. 3, each wing portion 96 is secured to the respective side of joist 12 after being folded downward, and is secured by a stainless steel ring nail disposed therethrough into joist 12. Tip 98 can also be selectively spaced away from the side of joist 12 slightly by slightly extracting the ring nail and the wing portion 96 therewith.

Figure 8:
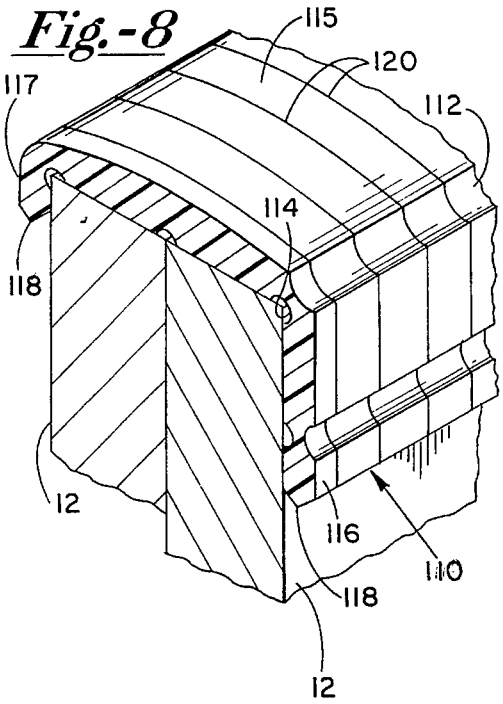
FIG. 8 is a sectional view of a cap with one wing preformed in a downward position, wherein the other wing can be folded at any of the webbings to facilitate adapting to two or more adjacent joists.

Referring to FIG. 8, still yet another alternative embodiment of the present invention is shown. A joist cap 110 is shown which is similar to joist cap 70 shown in FIG. 3, with a modified feature of one wing 117 having a fixed relationship with the horizontal segment having a domed upper surface 15. Thus, when adapted to joist 12, only the opposing end of joist cap 110 is folded downward about the appropriate hinge portion defined by a lower channel 114 and an upper channel 112, as shown. Opposing wing 116 is secured to the side of joists 12 using stainless steel ring nails as previously discussed. A pair of tapered tips 118 formed at each end of joist cap 110 point downwardly when adapted to joists 12 such that condensation or water will drip therefrom, and away from joist 12. Joist cap 110 is scored at locations 120, similar to the scoring already described. While joist cap 110 is shown adapted to two joists, the width of the notch defined by wings 117 and the folded down opposing portion of cap 110 can be defined to be equal to the width of one joist. Thus, one novel feature shown in FIG. 8 is a cap having one fixed end, wherein the other end can be selectively bent downward at the appropriate location, wherein the cap is adaptable to more than one joist, such that installation is quick, and alignment of the webs over the joist edges is easy to accomplish.

The joist caps shown in the various embodiments, illustrated in FIGS. 1–8, are ideally suited for exterior and outdoor uses where water, moisture and high humidity are often encountered. However, limitation to uses outdoors is not to be inferred. While outdoor structures, such as decks, gazebos, patios and porches have been described, the joist caps are also suitable for use to construct other structures, such as solariums or greenhouses, wherein a plurality of transparent plates are joined above a joist in a water tight arrangement. Hence, limitation to support structure 36 which is entirely made of wood is not to be inferred.

In summary, multiple embodiments of a water impermeable joist cap have been illustrated and disclosed which are adapted to be positioned about the top of one or more joists, and between the joist and supported structure such as flooring. The joist caps are made of water impermeable flexible material, and may be resilient, to prevent moisture from becoming trapped between the upper surface of the joist and the supported structure to increase the useful life thereof. Water which may become disposed on the outer surface of the joist cap is redirected outwardly and away from the joist cap to prevent rotting of the joist over time. The joist caps can be easily manufactured using extruding processes, using inexpensive plastic materials such as polypropylene of recycled materials, and which are easy to use during the construction process. The lengths of the joist caps can be easily chosen by breaking the joist caps using the pre-defined scoring along the length of the joist cap.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

In the claims:

I claim:

1. A joist cap adaptable to an end of a joist, comprising:

(a) an elongated water impermeable plate-like member having an upper surface and a lower surface and a length terminating in a pair of ends; and (b) a plurality of web means integrally formed into the plate-like member and extending the length thereof for facilitating bending of said plate-like member at said web means to conform said plate-like member to the end of the joist, said web means defined by a first groove in said upper surface and a second groove in said lower surface immediately opposite said first groove.

2. The joist cap as specified in claim 1 wherein said plurality of web means are spaced from one another at a pre-determined interval.

3. The joist cap as specified in claim 2 wherein said predetermined interval is approximately one and five-eighth inches.

4. The joist cap as specified in claim 1 wherein said plate-like member is scored to facilitate creating a predetermined length.

5. The Joist cap as specified in claim 1 wherein said plate-like member has a dome between a first and a second of said plurality of web means.

6. The joist cap as specified in claim 5 wherein a third of said plurality of web means routes moisture away from said joist.

7. A joist cap adaptable to an end of a joist, comprising:

(a) an elongated water impermeable plate-like member having an upper surface and a lower surface and a length terminating in a pair of ends; and (b) a plurality of web means integrally formed into the plate-like member and extending the length thereof for facilitating bending of said plate-like member at said web means to conform said plate-like member to the end of the joist, wherein said plate-like member has a dome between a first and a second of said plurality of web means and wherein a third of said plurality of web means routes moisture away from said joist, said web means defined by a first groove in said upper surface and a second groove in said lower surface immediately opposite said first groove.

8. The joist cap as specified in claim 7 wherein said plate-like member is scored to facilitate creating a predetermined length.

9. A joist cap adaptable to an end of a joist, comprising:

(a) an elongated water impermeable plate-like member having an upper surface and a lower surface and a length terminating in a pair of ends; and (b) a plurality of web means integrally formed into the plate-like member at pre-determined intervals of about one and five-eighth inches, said plurality of web means extending the length of said plate-like member for bending said plate-like member at said web means to conform said plate-like member to the end of the joist, said web means defined by a first groove in said upper surface and a second groove in said lower surface immediately opposite said first groove.

10. The joist cap as specified in claim 9 wherein said plate-like member is scored to facilitate creating a predetermined length.

* * * * *